US009503799B2

(12) United States Patent
Akino

(10) Patent No.: US 9,503,799 B2
(45) Date of Patent: Nov. 22, 2016

(54) HANDHELD MICROPHONE WITH A NOTCH FILTER AND A HIGH PASS FILTER

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 266 days.

(21) Appl. No.: 14/289,770

(22) Filed: May 29, 2014

(65) Prior Publication Data

US 2014/0376760 A1 Dec. 25, 2014

(30) Foreign Application Priority Data

Jun. 24, 2013 (JP) ..... 2013-131380

(51) Int. Cl.
*H04R 3/00* (2006.01)
*H04R 1/08* (2006.01)

(52) U.S. Cl.
CPC . *H04R 1/08* (2013.01); *H04R 3/00* (2013.01)

(58) Field of Classification Search
CPC ..... H04R 1/22; H04R 1/222; H04R 3/00; H04R 3/04
USPC ..... 381/111–117
See application file for complete search history.

(56) References Cited

U.S. PATENT DOCUMENTS

| | | | | |
|---|---|---|---|---|
| 6,226,386 | B1 * | 5/2001 | Akino | 381/173 |
| 2006/0078134 | A1 * | 4/2006 | Khenkin et al. | 381/113 |
| 2007/0136050 | A1 * | 6/2007 | Tourwe | 704/205 |
| 2013/0114833 | A1 * | 5/2013 | Thomas et al. | 381/122 |

FOREIGN PATENT DOCUMENTS

| | | |
|---|---|---|
| JP | 2008-712008 | 7/2008 |

* cited by examiner

*Primary Examiner* — Paul S Kim
*Assistant Examiner* — Katherine Faley
(74) *Attorney, Agent, or Firm* — Whitham, Curtis & Cook, P.C.

(57) ABSTRACT

A handheld microphone includes a microphone unit supported with a vibration insulator on a microphone case; the handheld microphone comprising a filter circuit for filtering output signals from the microphone unit; the filter circuit comprising a passive filter connected to an output terminal of the microphone unit, and a high-pass filter connected downstream of the passive filter and outputting the filtered signals from the microphone unit.

2 Claims, 6 Drawing Sheets

HANDHELD MICROPHONE WITH A NOTCH FILTER AND A HIGH PASS FILTER

TECHNICAL FIELD

The present invention relates to a handheld microphone that is resistant to vibratory noise without deterioration of the sound quality.

BACKGROUND ART

Various types of microphones are known. Among them, ones used by users holding the housings of microphones are called handheld microphones. The handheld microphone has a microphone unit mounted on the tip of the housing of the microphone.

The handheld microphone may suffer vibration generated by contact of the microphone body with, for example, the hand of a user holding the handheld microphone. The vibration is transmitted to the microphone unit to cause noise. The user may also move while holding the body, and may apply undesirable acceleration to the handheld microphone. Such acceleration also causes noise.

In order to prevent such noise, a typical handheld microphone has a structure appropriately designed for supporting the microphone unit. Such a structure includes a shock mount between the microphone unit and the microphone case (see Japanese Unexamined Patent Application Publication No. 2008-177633). The shock mount can protect the microphone unit from undesirable vibration applied to the microphone case.

The shock mount functions as a suspension. Even if undesirable vibration or acceleration is applied to the body of the handheld microphone, the shock mount can prevent such vibration from propagating toward the microphone unit. This configuration can prevent noise caused by the vibration (vibratory noise).

Unfortunately, the suspension also has an inherent resonant frequency. If the frequency of the undesirable vibration is equal to the resonant frequency, the vibration of the microphone unit is amplified. The suspension is consequently disposed so as to have a lower resonant frequency band than the sound pickup band of the microphone unit. This configuration can reduce contamination of the vibratory noise due to the suspension in the sound pickup band. It is however difficult to set the resonant frequency of the suspension outside the sound pickup band. The resonance of the suspension therefore causes larger vibratory noise than that without any suspension. The resonance of the suspension causes vibratory noise in a low frequency band. This noise is not readily audible to human ears. The resonant frequency of the suspension in a main sound pickup band however leads to larger audible vibratory noise.

A softer suspension can provide a lower resonant frequency of the suspension. A softer suspension however causes the microphone unit to sag due to the gravity and to readily come into contact with the interior of the microphone case. The contact also generates noise. As described above, the handheld microphone has a difficulty in adjusting the suspension so as to provide an appropriate resonant frequency value of the suspension holding the microphone unit and to certainly hold the microphone unit.

FIG. 6 is a graph illustrating example vibratory noise outputted due to vibration applied from a vibrator to a handheld microphone, and example frequency response of the handheld microphone.

In FIG. 6, a dotted line B indicates a frequency response of the handheld microphone. A solid line A indicates vibratory noise outputted from the handheld microphone including a suspension. As indicated by the solid line A in FIG. 6, the vibratory noise increases around 70 Hz, i.e., the resonant frequency of the suspension. The vibratory noise has a lower frequency than the main sound pickup band of the handheld microphone. Such a frequency band may cause a negative effect on the sound quality.

An example approach for reducing such vibratory noise is a reduction in noise component included in the output from the microphone unit through a filter circuit.

For example, a high-pass filter is used which has a higher cutoff frequency than the resonant frequency of the suspension. This configuration can reduce the vibratory noise from the suspension. If the cutoff frequency of the high-pass filter, however, approaches the main sound pickup band (if the cutoff frequency increases to a certain high level), this causes deterioration of the sound quality in the main sound pickup band. Such deterioration of the sound quality may be prevented with a high-pass filter having a higher order. A high-pass filter however cannot provide sufficient attenuation of the vibratory noise level in the resonant frequency of a suspension having a high Q-value.

In another approach, the output from the microphone unit is processed with a notch filter as an active filter. Only the main sound pickup band can thereby be extracted to reduce the vibratory noise. The active filter is however composed of complicated circuitry, readily causes distortion, and cannot provide a sufficient dynamic range.

For example, the output from the microphone unit may also be processed through the notch filter or passive filter. FIG. 3 illustrates example output (frequency characteristics) from the microphone unit through the notch filter or passive filter. In FIG. 3, the horizontal axis represents frequency while the vertical axis represents the output level of the microphone. As illustrated in FIG. 3, the output can be attenuated in the frequency band (about 70 Hz) of the vibratory noise amplified by the resonance of the suspension. However, the output level around 100 Hz decreases in response to sufficient attenuation of the vibratory noise. That is, the vibratory noise cannot sufficiently be attenuated only through the notch filter as a passive filter.

SUMMARY OF INVENTION

Technical Problem

It is an object of the present invention to provide a handheld microphone having a vibration insulating structure, the handheld microphone including an unprecedented filter effectively absorbing vibratory noise without deterioration of the sound quality.

Solution to Problem

According to an aspect of the present invention, a handheld microphone includes a microphone unit supported with a vibration insulator on a microphone case; the handheld microphone comprising a filter circuit for filtering output signals from the microphone unit; the filter circuit comprising a notch filter connected to an output terminal of the microphone unit, and a high-pass filter connected downstream of the notch filter and outputting the filtered signals from the microphone unit.

Advantageous Effects of Invention

A handheld microphone according to the present invention is resistant to vibratory noise and can prevent deterioration of the sound quality.

DESCRIPTION OF EMBODIMENT

A handheld microphone according to an embodiment of the present invention will now be described with reference to the accompanying drawings. The present invention characterized by filter circuitry included in a microphone unit inside the handheld microphone.

Figure 2:
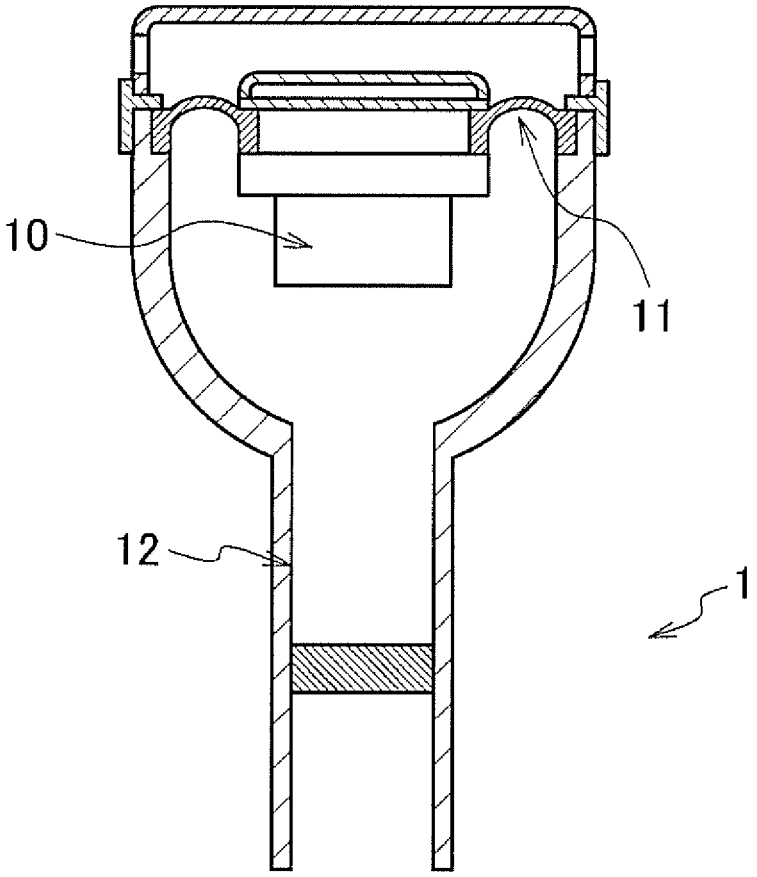
FIG. 2 is a longitudinal cross-sectional view illustrating an example configuration of the handheld microphone according to the present invention.

With reference to FIG. 2, an example basic configuration of the handheld microphone according to the present invention will now be described. In FIG. 2, the handheld microphone 1 supports a microphone unit 10 with a shock mount 11. A shock mount 11 is a vibration insulator (suspension) disposed inside the tip of a microphone case 12. When a user holds the microphone case 12, undesirable vibration occurs in the microphone case 12. The vibration propagates toward the entire microphone case 12. The vibration is however attenuated by the shock mount 11 and does not propagate to the microphone unit 10.

The handheld microphone 1 includes a filter circuit. The filter circuit filtering-processes the output signals from the microphone unit 10. The filter circuit is mounted on a circuit substrate connected to the output terminal of the microphone unit 10.

Figure 1:
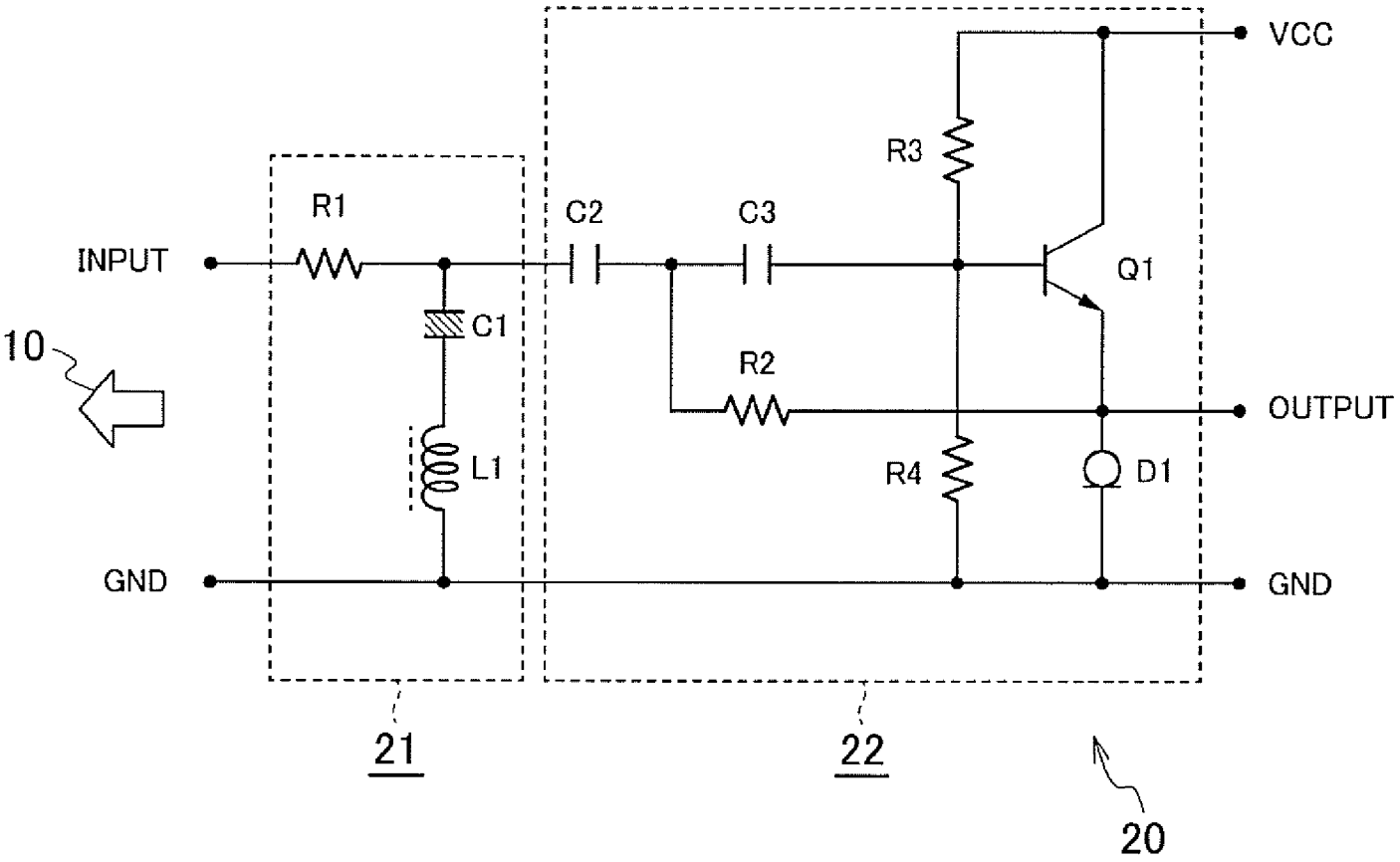
FIG. 1 is a circuit diagram illustrating an example filter circuit in a handheld microphone according to the present invention.

An example filter circuit in the handheld microphone 1 will now be described. FIG. 1 is a circuit diagram illustrating an example filter 20 included in the handheld microphone 1 according to the present embodiment. As illustrated in FIG. 1, the filter 20 is disposed downstream of the microphone unit 10. The filter 20 is connected to the output terminal of the microphone unit 10. The filter 20 includes a notch filter 21 and a high-pass filter 22 in this order downstream of the microphone unit 10.

The notch filter 21 consists of passive filter and is connected to the terminal output of the microphone unit 10. The notch filter 21 is a series resonator including an inductor L1 and a capacitor C1. The notch filter 21 is also called a band-stop filter and stops passage of signals in a certain frequency band.

The high-pass filter 22 consists of active filter and is a second-order high-pass filter. The high-pass filter 22 feeds back its output to the base of a transistor Q1. The high-pass filter 22 can have an enhanced frequency response at or around a frequency corresponding to approximately 1.4 times the cutoff frequency of the notch filter 21, the frequency response being enhanced by adjusting the resistance value of a feedback resistor R2.

Figure 4:
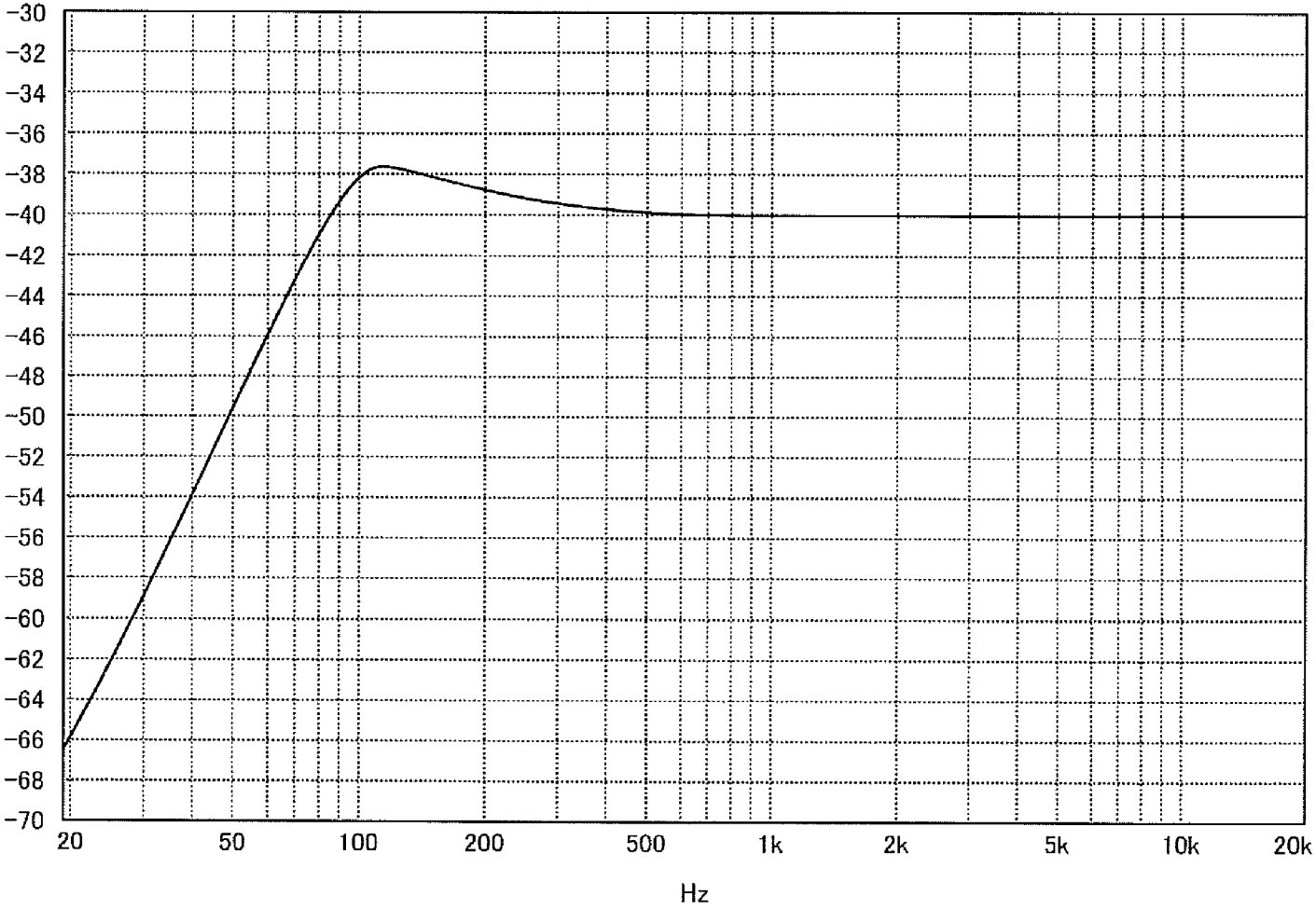
FIG. 4 is a graph illustrating an example frequency response of a high-pass filter in the filter circuit.

FIG. 4 is a graph illustrating the frequency response after the adjustment of the feedback resistor R2 of the high-pass filter 22. As illustrated in FIG. 4, the frequency response is enhanced at or around 100 Hz corresponding to L4 times the frequency (around approximately 70 Hz) of the cutoff frequency of the notch filter 21.

Figure 5:
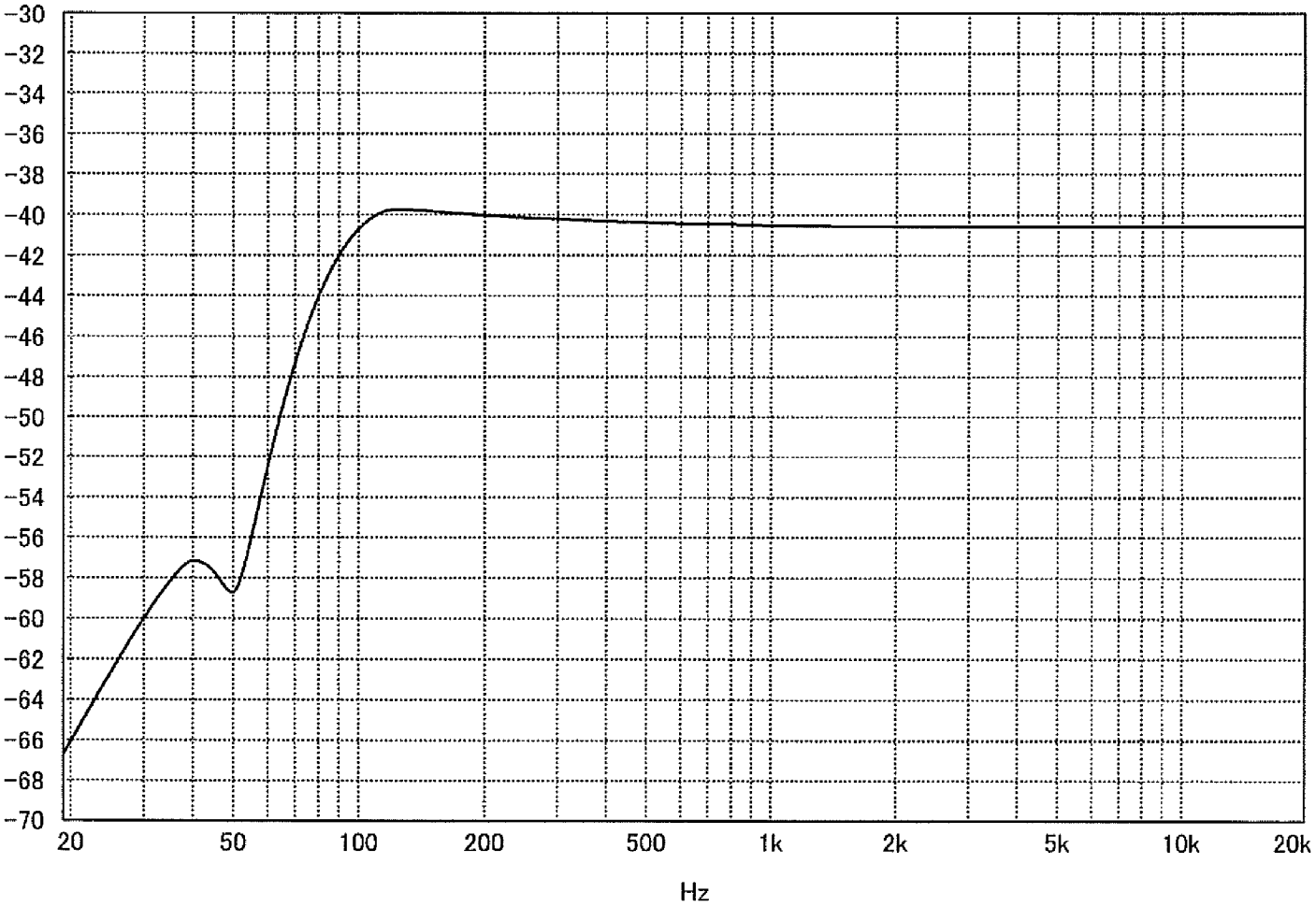
FIG. 5 is a graph illustrating an example frequency response of the filter circuit.
Figure 6:
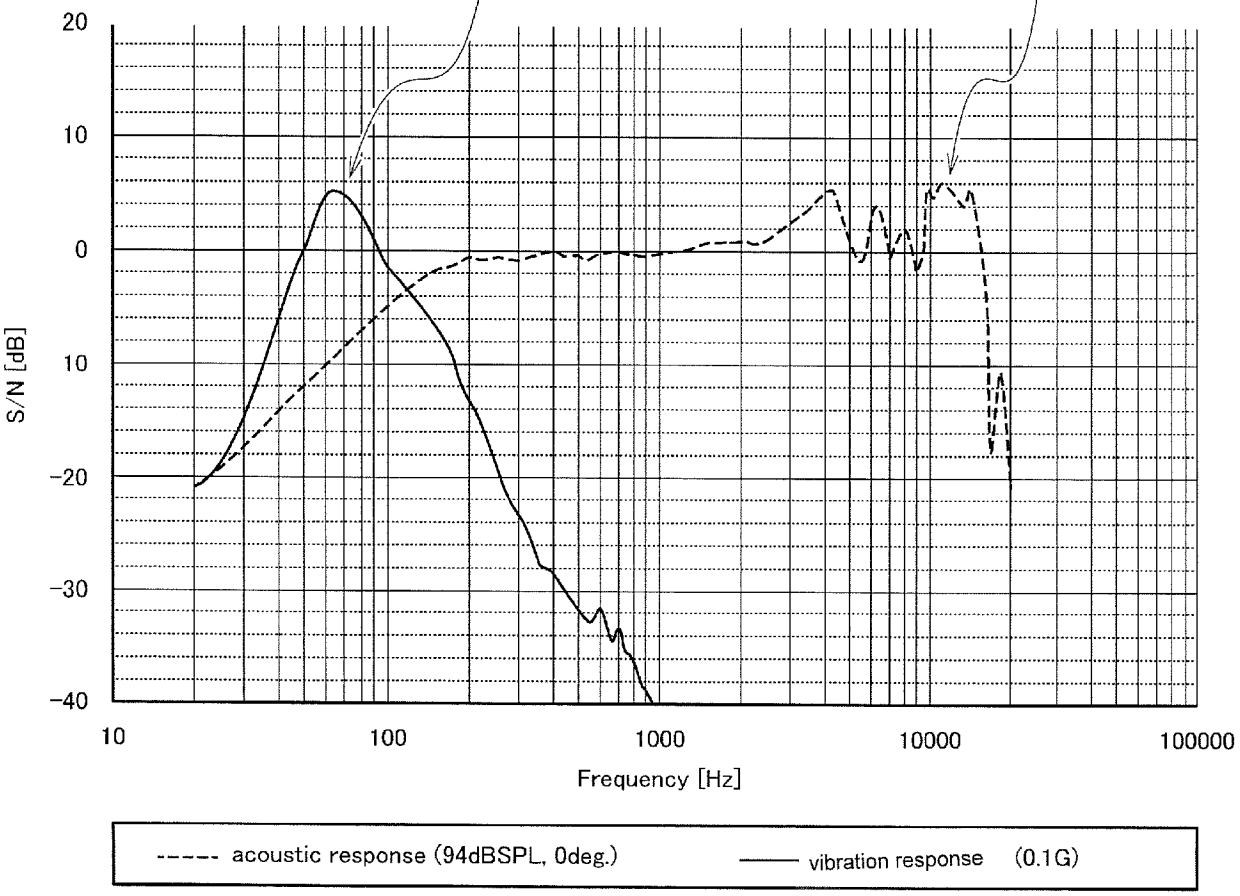
FIG. 6 RELATED ART
FIG. 6 is a graph illustrating example vibratory noise generated by applying vibration from a vibrator to a conventional handheld microphone.

FIG. 5 illustrates an example frequency response of the filter 20 connected to the output of the microphone unit 10. FIG. 5 is a graph of the example frequency response of the handheld microphone 1, the horizontal axis representing a frequency, the vertical axis representing an output level.

Figure 3:
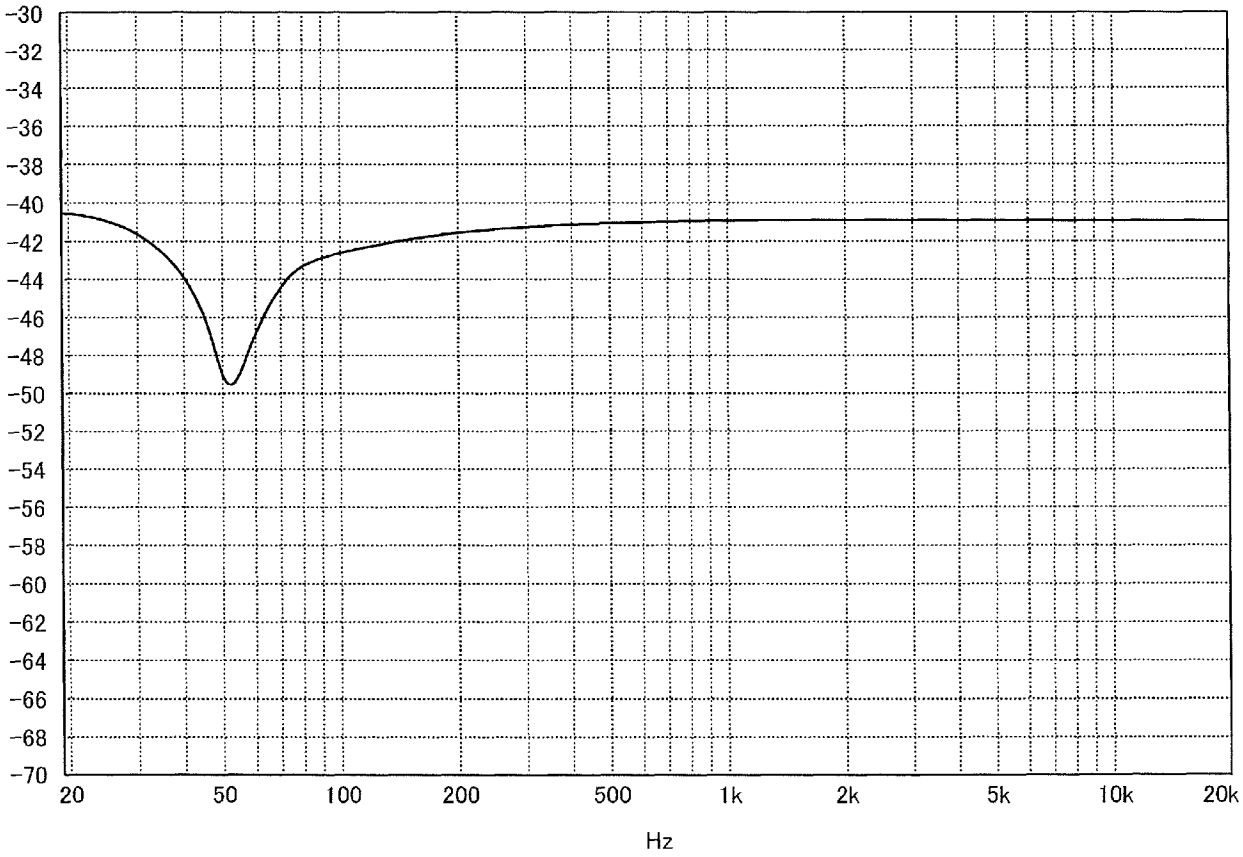
FIG. 3 Prior Art
FIG. 3 is a graph illustrating an example frequency response obtained by applying a notch filter to the output of a microphone unit.

As illustrated in FIG. 5, the frequency response of the handheld microphone 1 corresponds to a combination of the frequency response of the notch filter 21 illustrated in FIG. 3 with the frequency response of the high-pass filter 22 illustrated in FIG. 4.

As illustrated in FIG. 5, the frequency response characteristics of the handheld microphone 1 indicate that the notch filter 21 attenuates the output around 70 Hz in the shock mount 11. The frequency response around 100 Hz attenuated by the notch filter 21 is recovered by the high-pass filter 22.

The vibratory noise generated by resonance of the shock mount 11 is therefore attenuated, and the frequency response characteristics in the main sound pickup band is substantially flat. In other words, the filter 20 having the notch filter and a second-order high-pass filter can be used to reduce the signal level (vibratory noise) caused by the resonant frequency of the suspension by about 18 dB. In a higher frequency band than the main sound pickup band (100 Hz), an output level attenuated in the notch filter can be corrected in the high-pass filter, and the output level can be flat. As a result, a sound quality picked-up by the microphone unit can be stabilized over the entire main sound pickup band.

As described above, a handheld microphone according to the present invention is resistant to vibratory noise and can prevent deterioration of the sound quality.

What is claimed is:

1. A handheld microphone including a microphone unit supported with a vibration insulator on a microphone case, the handheld microphone comprising a filter circuit for filtering output signals from the microphone unit;

the filter circuit comprising a notch filter connected to an output terminal of the microphone unit, and a high-pass filter connected downstream of the notch filter and outputting filtered signals from the microphone unit, wherein the notch filter is a passive filter, wherein the high-pass filter is an active filter, and wherein the filter circuit absorbs vibratory noise from the vibration insulator and frequency response characteristics in a main sound pick up band are substantially flat.

2. The handheld microphone according to either claim 1, wherein the high-pass filter is a second-order high-pass filter.

* * * * *